United States Patent [19]

Kaku

[11] 4,337,816

[45] Jul. 6, 1982

[54] PROCESS FOR PRODUCING SPHERICAL GRAPHITE CASTINGS

[75] Inventor: Yasuo Kaku, Hiroshima, Japan

[73] Assignee: Mitsubishi Jukogyo Kabushiki Kaisha, Tokyo, Japan

[21] Appl. No.: 256,988

[22] Filed: Apr. 24, 1981

Related U.S. Application Data

[63] Continuation of Ser. No. 82,521, Oct. 9, 1979, abandoned.

[30] Foreign Application Priority Data

Oct. 9, 1978 [JP] Japan ..... 53-123526

[51] Int. Cl.[3] ..... B22D 27/00

[52] U.S. Cl. ..... 164/58.1; 75/130 AB

[58] Field of Search ..... 164/55.1, 56.1, 57.1, 164/58.1, 59.1; 75/130 AB

[56] References Cited

U.S. PATENT DOCUMENTS 786,009 3/1905 Cowden ..... 164/58.1

1,374,509 4/1921 Lomax ..... 164/59.1

FOREIGN PATENT DOCUMENTS 51-81732 7/1976 Japan ..... 164/57.1

*Primary Examiner*—Gus T. Hampilos

*Assistant Examiner*—K. Y. Lin

*Attorney, Agent, or Firm*—Holman & Stern

[57] ABSTRACT

A process for producing spherical graphite cast iron characterized by arranging a required amount of sphering alloy blocks in the hollow part for making a product of a casting mold and then pouring a melt into the casting mold; and a process for producing compound castings consisting of spherical graphite cast iron and ordinary cast iron characterized by arranging a required amount of sphering alloy blocks in the hollow part for making a product and requiring the strength of the product of a casting mold and pouring an ordinary cast iron melt into the casting mold.

3 Claims, 6 Drawing Figures

PROCESS FOR PRODUCING SPHERICAL GRAPHITE CASTINGS

This is a continuation of application Ser. No. 082,521, filed Oct. 9, 1979, now abandoned.

This invention relates to an improved process for producing sphered graphite castings.

A ladle placing pouring method and a ladle inserting method have been so far generally adopted for the process for producing sphered graphite castings. The ladle placing pouring method is a method wherein a sphering agent is placed in the bottom of a ladle and a cast iron melt is poured into the ladle from above so as to be a sphered graphite melt. The ladle inserting method is a method wherein a sphering agent is inserted and added into a ladle filled with a cast iron melt.

These methods have an advantage that a large amount of a melt, for example, up to about 100 tons can be treated at once to be sphered. However, these methods have defects that flashes and white smoke are generated by the reaction of the sphering agent with the melt at the time of the treatment, therefore the working environment becomes very bad, the melt temperature reduces, the retention of the sphering agent is low, the effect of the sphering agent will be lost unless the treated melt is poured within a short time and the so-called fading must be considered.

Besides the above mentioned methods, there is recently recommended an in-mold method mentioned in the publication of Japanese patent publication No. 1620/1971 and others. The summary of this method shall be explained with reference to FIG. 1. In FIG. 1 showing a sectioned view of a casting mold by the in-mold method, 1 is a melt inlet port, 2 is a melt passage, 3 is a reaction chamber, 4 is a sphering agent, 5 is a shrinker, 6 is a hollow part for making a casting, 7 is refractory casting mold such as silica, 8 is an upper mold casting frame and 9 is a lower mold casting frame. A cast iron melt is poured in through the melt inlet port 1, passes through the melt passage 2 and reaches the reaction chamber 3. Here, the cast iron melt reacts with the sphering agent 4 so as to become a sphered graphite cast iron melt, passes through the shrinker 5, fills the hollow part 6 for making a casting and here coagulates to obtain a sphered graphite casting. The advantages of this in-mold method are that flashes and white smoke are not generated, therefore the working environment does not deteriorate and, as the melt is poured into the hollow part for making a casting just after the sphering treatment is made in the reaction chamber, it is not necessary to consider the fading of the sphering and inoculating effects. However, it has defects that, as the reaction in the reaction chamber 3 is temporary, a large casting (of more than 1 ton) is sphered nonuniformly and a casting of a uniform quality is hard to obtain and further, as the reaction chamber is provided, the casting volume retained for the cast product is reduced by the volume of the reaction chamber.

A first object of the present invention is to provide a process for producing sphered graphite castings wherein these defects of the conventional methods are reduced, the working environment is good, the casting quality is high, the casting volume retained is high and a large casting of more than 1 ton can be economically made.

A second object of the present invention is to provide a process for producing compound castings consisting of spherical graphite cast iron parts high in strength and ordinary cast iron parts.

As a result of research, it has been discovered that the above mentioned objects can be attained by making a cast iron melt react with a sphering agent in a hollow part for making a casting resulting in the present invention.

That is to say, the present invention relates to a process for obtaining spherical graphite cast iron by arranging a calculated amount of sphering alloy blocks within a hollow for making a product of a casting mold and pouring a melt into the casting mold, and a process for obtaining compound castings consisting of spherical graphite cast iron and ordinary cast iron by arranging a required amount of sphering alloy blocks within a casting mold hollow in the part requiring the strength of the casting and pouring an ordinary cast iron melt into the hollow.

These objects, other objects, features and advantages of the present invention will become more definite with the following detailed explanation and drawings.

Figure 1:
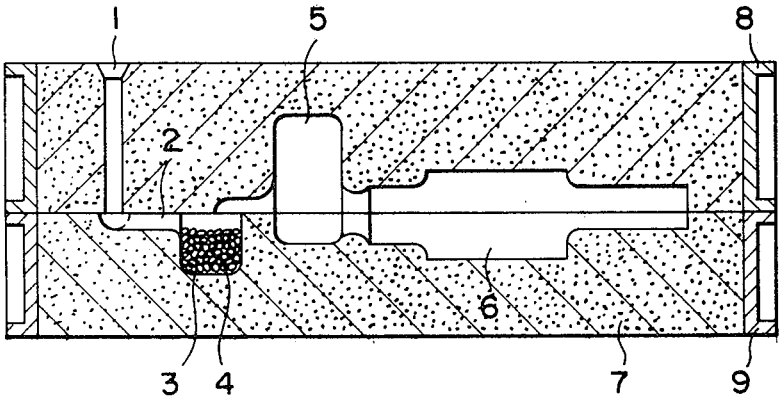
FIG. 1 is a sectioned view of a casting mold by a conventional method.
Figure 2:
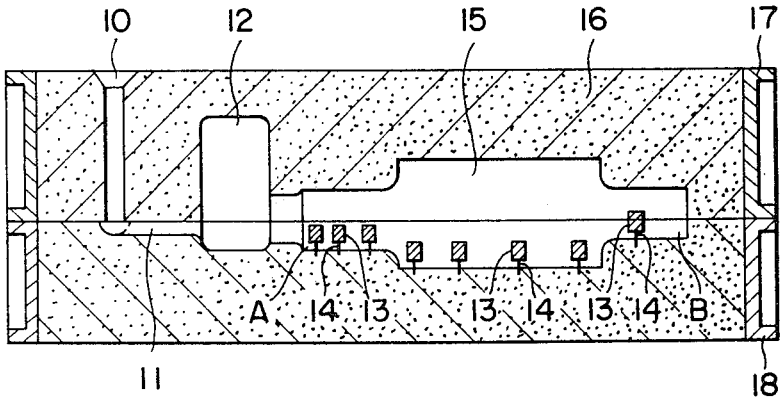
FIG. 2 is a sectioned view of a casting mold of an embodiment of the method according to the present invention.

The present invention shall be explained with reference to FIG. 2 showing a sectioned view of a casting mold according to the method of the present invention. 10 is a melt inlet port. 11 is a melt passage. 12 is a shrinker. 13 is a sphering agent block. 14 is a supporting rod holding the sphering agent block. 15 is a hollow part for making a casting. 16 is a refractory casting mold such as of silica. 17 is an upper mold casting frame. 18 is a lower mold casting frame.

A cast iron melt is poured in through the melt inlet port 10, passes through the melt passage 11 and shrinker 12 and reaches the hollow part 15 for making a casting. The cast iron melt reacts in contact with the sphering agent blocks 13 in the hollow part 15 for making a casting, becomes a sphered graphite case iron melt, fills the hollow part 15 and then coagulates to be a sphered graphite casting.

The sphering agent blocks 13 are properly arranged from calculation and experience values by the shape and size of the cast product. In the part A near the melt inlet through which all the melt passes, many sphering agent blocks 13 are arranged but, in the part B where the melt stops, few sphering agent blocks 13 are arranged so that the entire casting may be uniformly sphered. The supporting rod 14 is made of a soft steel rod or the like higher in melting point than the sphering agent block 13.

According to the method of the present invention, a proper number of the sphering agent blocks 13 is arranged by the size and shape of the casting and the flow volume in contact with the melt and therefore, as compared with the conventional in-mold method, even in a large casting, a homogeneous spherical graphite casting can be obtained. Due to the sphering reaction within the hollow part 15 for making a casting, the melt is not sphered in the melt inlet port 10 and shrinker 12 where the sphering of the melt is not required. Therefore, there is an advantage that the retention of the sphering agent is higher than in the conventional method. Further, in the conventional in-mold method, a reaction chamber for the sphering agent is required, whereas, in the present invention, as the melt reacts in the hollow part 15 for making a casting, no sphering agent reaction chamber is required and therefore the retained volume of the casting is high.

Further, as compared with the ladle placing pouring method and ladle inserting method, the present invention has the advantages that flashes and white smoke are not generated in the reaction of the sphering agent, therefore the environment is good, the retention of the sphering agent is high and fading need not be considered. Further, there are advantages that, by setting the sphering agent blocks in desired parts, a compound casting of partly sphered graphite can be made and the retention of the sphering agent can be increased.

Figure 3:
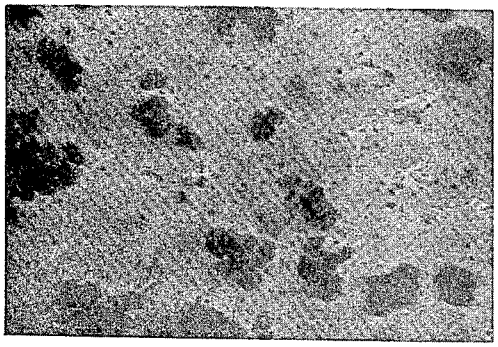
FIG. 3 is a microscopic structure photograph of a casting by the conventional method.
Figure 4:
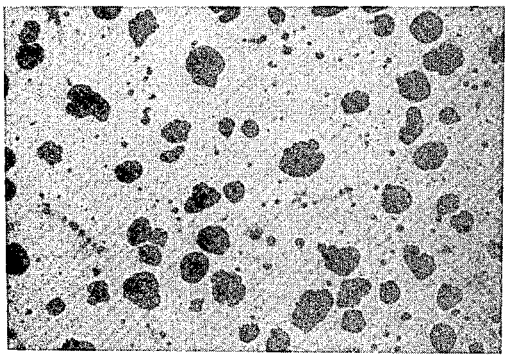
FIG. 4 is a microscopic structure photograph of a casting by the method according to the present invention.

Microscopic structure photographs of castings made to compare the method of the present invention with the conventional method on large castings are shown in FIGS. 3 and 4. Each was taken from the central part of a test piece of a thickness of 50 mm. attached to the large casting body. The magnification of the photograph is 100 times.

FIG. 3 is a microscopic structure photograph of a casting by the conventional ladle inserting method. In this case, as time elapsed from the sphering treatment to the completion of the casting, the melt faded and the sphering of graphite failed.

As an embodiment of the present method, a sphering agent consisting of an Fe-Si-Mg alloy (for example, of 8% Mg and 60% Si, the rest being Fe) was used within a casting mold. Fe-Si-Mg alloy sphering agent blocks of a weight of 0.65% based on the weight of the cast product were arranged within the casting mold and a melt of low sulfur melted in a low frequency furnace was poured into the mold to form a large casting. In its microscopic structure, as shown in FIG. 4, the sphering rate was high, no fading phenomenon was recognized, the retention of the sphering agent was high in the analysis of the chemical composition, 0.04% remaining Mg was recognized and a very excellent material as a sphered graphite casting was shown.

Figure 5:
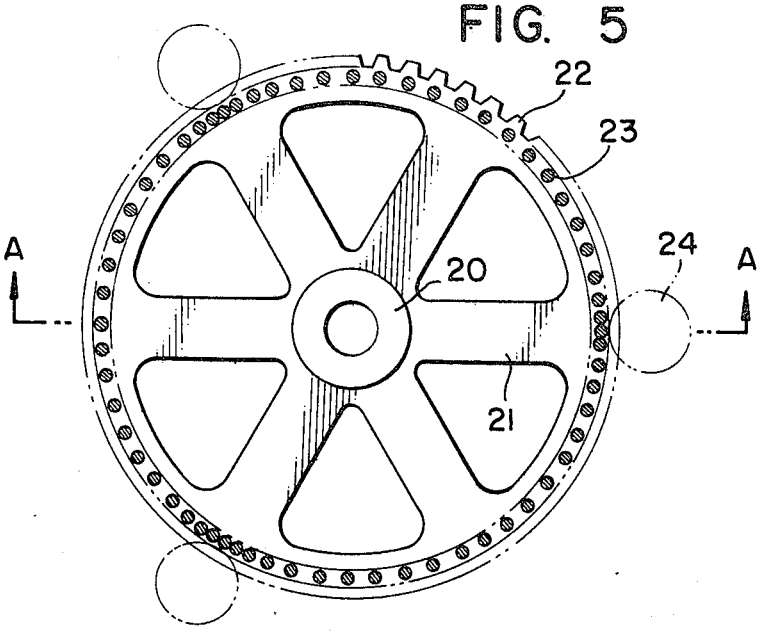
FIG. 5 is an explanatory plan view showing another embodiment of the method according to the present invention.
Figure 6:
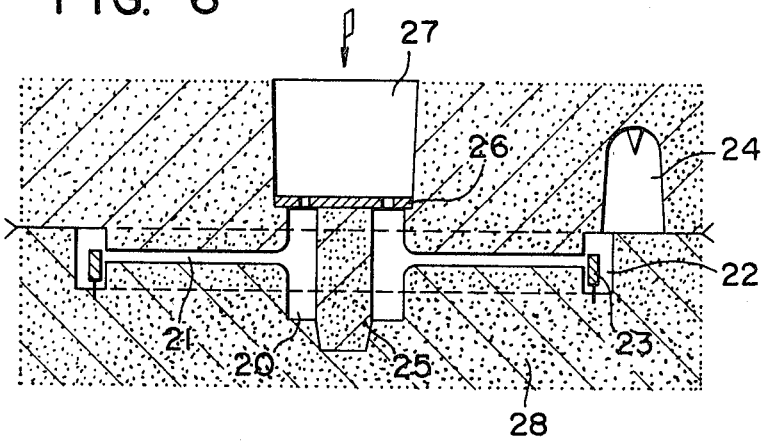
FIG. 6 is a sectioned view on line A—A in FIG. 5.

As another embodiment, a casting having one part consisting of spherical graphite cast iron higher in strength and a second part consisting of ordinary cast iron in the same casting was made. In a conventional gear or the like of spherical graphite cast iron, the tooth tip part must be of the strength of the spherical graphite cast iron but the boss and spoke parts may be of the lower strength of ordinary cast iron. However, as an object having differing strengths in different structures in the same castings can not be simply cast, such casting have been so far cast of a melt of spherical graphite cast iron with the tooth tip part as high in strength as the base. The present invention is to provide a low cost casting by easily solving these problems. An embodiment of the present invention is shown in FIGS. 5 and 6. FIG. 5 shows a plan view of a gear casting mold. FIG. 6 shows a section on line A—A in FIG. 5. In FIG. 5, 20 is a boss part, 21 is a spoke part, 22 is a tooth tip part, 23 is a sphering agent block and 24 is a shrinker.

In FIG. 6, the same parts as in FIG. 5 are indicated by the same respective numerals. An ordinary cast iron melt is poured in from the direction indicated by the arrow above a pressing melt part 27, passes through a descaling part 26, flows through the boss part 20 and spoke part 21 and reacts in contact with the sphering agent blocks 23 arranged in advance in the tooth tip parts 22. 28 is a casting sand of a refractory material. The sphering agent blocks 23 are properly placed by considering whether the alloy is Fe-Si-Mg, Si-Ca-Mg, Si-Ce-Mg-RE or Fe-Mg, the mixing rate and amount of use of the alloy and the time of contact of the alloy with the melt depending on whether an early reaction or slow reaction and the use. Particularly, in the shrinker 24 part of the embodiment, the sphering agent blocks 23 increased by the volumetric ratio of the shrinker are arranged, or a sphering alloy slow in the reaction with the melt is used.

By setting the sphering agent blocks 23 as partly distinguished and pouring the melt as in the above, the casting strength can be retained only in the parts requiring it. Therefore, in the gear of the embodiment, the tooth tip part 22 is of spherical graphite cast iron high in strength, the boss and spoke parts have the property of ordinary cast iron, and a casting having two kinds of strengths is made. A gear can be provided which is different from the conventional gear of all spherical graphite cast iron, is not of an excess quality, is in conformity with the intended use and is low in cost.

What is claimed is:

1. A process for molding cast iron comprising arranging within the mold's hollow part a plurality of sphering alloy blocks, the sphering alloy being selected from one of the groups consisting of Fe-Si-Mg, Si-Ca-Mg, Si-Ce-Mg-Re, or Fe-Mg, and then pouring an iron melt into the casting mold, so that spherical graphite cast iron is formed in situ around the sphering alloy blocks, with the provisos that (a) each sphering block is attached to one end of a supporting rod made of a soft steel whose melting point is higher than that of the sphering alloy, the other end of which is attached to the inner wall of the mold's hollow part, so that the sphering block is not in direct contact with the mold wall, and (b) the concentration of sphering blocks is greater at the inlet end of the mold's hollow part and lesser at the far end of the hollow part.

2. The process of claim 1 wherein the sphering alloy is Fe (32%)-Si (60%)-Mg (8%).

3. The process of claim 2 wherein 0.65% by weight of the sphering alloy is employed, based on the weight of the cast object.

* * * * *